United States Patent [19]

DeForest et al.

[11] 4,157,147

[45] Jun. 5, 1979

[54] CONTAINER

[75] Inventors: Laurence R. DeForest, Gladstone, Mo.; Frank P. Richards, Prairie Village, Kans.

[73] Assignee: Phillips Petroleum Company, Bartlesville, Okla.

[21] Appl. No.: 782,689

[22] Filed: Mar. 30, 1977

[51] Int. Cl.[2] ..... B65D 3/04; B65D 3/12; B65D 5/56; B65D 5/62

[52] U.S. Cl. ..... 220/455; 220/359; 220/456; 220/457; 229/4.5; 229/5.5; 229/43

[58] Field of Search ..... 229/43, 1.5 B, 4.5, 229/5.5; 113/121; 93/29.1 R; 220/455, 456, 457, 359, 67, 66

[56] References Cited

U.S. PATENT DOCUMENTS

| | | | |
|---|---|---|---|
| 1,417,707 | 5/1922 | Wright | 229/5.5 X |
| 1,489,950 | 4/1924 | Kronquest | 220/72 X |
| 1,706,007 | 3/1929 | Van Alstyne et al. | 229/43 |
| 2,123,543 | 7/1938 | Morris | 93/1.3 |
| 2,372,740 | 4/1940 | Ringler | 229/5.5 X |
| 2,784,901 | 3/1957 | Wilcox | 229/43 |
| 2,888,861 | 6/1959 | Meyer-Jagenberg | 93/39.1 R |
| 2,926,832 | 3/1960 | Negoro | 229/7 R |
| 3,182,882 | 5/1965 | Aellen, Jr. et al. | 229/4.5 |
| 3,278,011 | 10/1966 | Viemeister | 206/45.14 |
| 3,369,726 | 2/1968 | Wilcox | 229/5.5 |
| 3,391,847 | 7/1968 | Christine et al. | 229/1.5 B |
| 3,454,208 | 7/1969 | Ambers | 229/1.5 B |
| 3,817,417 | 6/1974 | Edwards | 229/43 |
| 3,944,126 | 3/1976 | Richards | 229/4.5 |
| 3,988,521 | 10/1976 | Fumel et al. | 229/1.5 B |

*Primary Examiner*—William Price
*Assistant Examiner*—Allan N. Shoap

[57] ABSTRACT

A container is disclosed comprising a generally cylindrical or conical tubular sidewall; a bottom closure secured to a lower portion of the sidewall to seal the bottom end of the container; and an inwardly disposed rim being circumferentially continuous about the periphery of the top end of the container and comprising an upper end portion of the sidewall extending inwardly, downwardly, and outwardly in such a fashion that the edge of the inner surface of the upper end of the sidewall is in a position which is higher than the lowest portion of the rim. The incorporation of a top closure with such a container is also disclosed.

3 Claims, 10 Drawing Figures

CONTAINER

This invention relates to the art of container manufacture. In one aspect this invention relates to novel container structure. In another aspect this invention relates to a method for producing a container having novel structure. In yet another aspect this invention relates to containers having sidewalls that are generally conical or cylindrical. In still another aspect this invention relates to containers in which the sidewalls are constructed of paperboard or similarly flexible materials.

Generally cylindrical and conical containers, that is, those containers in which the cross sections perpendicular to their longitudinal axis are circular, are known in the art. See, for example, the disclosures in U.S. Pat. Nos. 2,413,449; 2,888,861; 3,369,726; and 3,944,126.

It is an object of the present invention to provide cylindrical and conical containers having novel features and construction.

It is also an object of this invention to provide cylindrical and conical containers the upper end of which is more resistant to having its shape deformed than the prior art cylindrical and conical containers having outwardly disposed rims.

Yet another object of this invention is to provide cylindrical and conical containers the upper end of which is particularly well suited for the application of certain desirable forms of top closure.

It is also an object of the present invention to provide a method for producing such novel containers.

Further and more specific objects of this invention will be apparent from the following description, the drawings and the appended claims.

SUMMARY OF THE INVENTION

The present invention provides a container having a generally cylindrical or conical tubular sidewall; a bottom closure secured to a lower portion of the sidewall to seal the bottom end of the container; and an inwardly disposed rim on the top end of the container, said rim being circumferentially continuous about the periphery of the top end of the container and comprising an upper end portion of the sidewall extending inwardly, downwardly, and outwardly in such a fashion that the edge of the inner surface of the upper end of the sidewall is in a position which is higher than the lowest portion of the rim.

Preferably, the rim on the top end of the container comprises an upper end portion of the sidewall extending inwardly, downwardly, and outwardly in a generally continuously curved fashion so that the surface of the inwardly disposed rim is generally curved. In accordance with an especially preferred embodiment of this invention the rim comprises an upper end portion of the sidewall extending inwardly, downwardly, and outwardly in a generally continuously curved fashion so that the surface of the inwardly disposed rim is generally curved and so that the inner edge of the upper end of the sidewall contacts the inner surface of the sidewall. This results in a rim having generally arcuate or circular-shape with respect to a vertical cross section through a section of the rim. In another embodiment, the rim comprises an upper end portion of the sidewall extending inwardly, downwardly, outwardly, and upwardly in a generally continuously curved fashion. In fact, it is within the scope of this invention to roll an upper end portion of the sidewall upon itself to whatever extent is desired. For example, the upper end of the sidewall could be turned in a generally curved fashion inwardly, downwardly, outwardly, upwardly, inwardly, downwardly, and back outwardly.

The amount of the upper end of the sidewall that is used in making the rim and the size of the rim can vary depending upon the sidewall material employed, the degree of reinforcement needed, and the dimension desired for the opening in the top end of the container. It is generally suitable if the rim is of such size and shape that the ratio of the rim's largest dimension parallel to the sidewall to its largest dimension perpendicular to the sidewall is in the range of about 4 to 1 to about 1 to 4 and the rim's largest dimension perpendicular to the sidewall is about 3 to about 10 times the thickness of the sidewall. Preferably, the ratio of the rim's largest dimension parallel to the sidewall to its largest dimension perpendicular to the sidewall is in the range of about 1.5 to 1 to about 1 to 1.5 and the rim's largest dimension perpendicular to the sidewall is about 4 to about 8 times the thickness of the sidewall. (For the foregoing comments it is to be noted that the dimension perpendicular to the sidewall is intended to be measured from the exterior side of the sidewall to the innermost surface of the rim which is inside the container.)

While the material used for the sidewalls is not considered to be critical, the container features here disclosed are particularly beneficial for containers in which the sidewall is relatively flexible. For example, the features here disclosed are particularly beneficial for containers in which a strip of the sidewall has flexibility of at least about the same order of magnitude as a similar strip of a single ply of the paperboard base stock generally used in currently produced paperboard milk cartons. The paperboard base stock generally used in such milk cartons has a thickness in the range of about 14 mils to about 28 mils and about 3000 square feet of that base stock weighs about 180 to about 360 pounds (i.e., a basis weight of about 180 to about 360 pounds). Cylindrical and conical containers of the present invention having sidewalls of such flexibility are more resistant to having their generally circular cross sections deformed by exterior forces, than are prior art cylindrical and conical containers having sidewalls constructed of such relatively flexible material. Accordingly, the present invention is particularly useful for the "all-paper" containers, i.e., those in which the sidewalls and any container closures are all constructed of paperboard base stock of the type generally used in making milk cartons.

The sidewall can be formed of a single thickness of sidewall material or of multiple plys of sidewall material. The sidewall can be formed using any technique known in the art as being suitable for producing tubes. One such technique involves spirally wrapping a strip of sidewall material and severing the resulting wound tubing into the desired lengths. Another technique involves folding a sidewall blank around a mandrel so that one side of one edge margin of said blank is overlapped and secured to the opposite side of the opposite edge margin of said blank. Such a technique is discussed in both U.S. Pat. Nos. 3,944,126 and 3,369,726, the disclosures of which are hereby incorporated by reference.

The type of bottom closure employed in this invention is not considered critical. Any type of bottom closure known in the art as suitable for sealing the bottom of conical or cylindrical containers can be employed. In a particularly preferred embodiment where the sidewall and the bottom closure are both formed of paperboard, the bottom closure is a generally cylindrical disk having a depending skirt which is bonded to the lower portion of the sidewall and rolled and crimped inwardly with the bottom edge of the sidewall to form a crimped seal. An example of such a bottom closure is disclosed in U.S. Pat. No. 3,944,126, the disclosure of which is incorporated herein by reference.

The container of this invention can also include a top closure which seals the upper end of the container. Any suitable closure can be employed, including removable friction or snap type closures. In a preferred embodiment of this invention the container is provided with a top closure comprising paperboard, metal foil, thermoplastic film, or thermoplastic sheet bonded to the upper surface of the inwardly rolled rim in such a fashion as to provide a continuous line of bonding around the top end of the container. While such a top closure can be bonded merely tangentially to the upper surface of the inwardly rolled rim, it is presently preferred that the bonding between the closure and the rim extend downwardly both inwardly and outwardly from the uppermost surface of the inwardly rolled rim. The top closure in such an embodiment can be bonded to the upper edge of the inwardly rolled rim in any suitable manner known in the art. For example, adhesives of various types can be used, including thermoplastic and thermosetting materials. When the upper closure is a thermoplastic film, the bond can be provided by heating the film prior to applying it to the rim. In a preferred embodiment when a metal foil or paperboard upper closure is employed, the surface of the closure that is to be bonded to the rim contains a coating of a thermoplastic material, such as polyethylene, wax, and the like. With such closures the thermoplastic coating on the closure can be heated so that when it is in contact with the rim a suitable bond can be obtained. Alternatively, if the outer surface of the container sidewall and the inwardly disposed rim having a thermoplastic coating the rim can be heated so that when it is in contact with the closure a suitable bond can be obtained. The best bonds are obtained when both the rim and the closure have a thermoplastic coating.

In order to further illustrate the present invention reference will now be made to the drawings.

Figure 1:
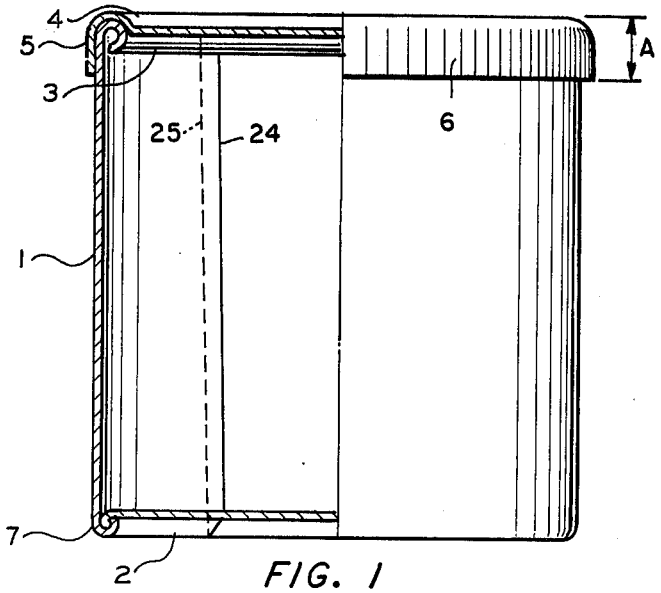
FIG. 1 is an elevational view, partly in cross section, of a cylindrical container embodying the present invention.

FIG. 1 shows a partial cross-sectional view of a container representative of one embodiment of the present invention. The container includes a sidewall 1 in the form of a cylindrical tube, a bottom closure 2 secured to a lower portion of the tube, an inwardly disposed rim 3, and a top closure 4 bonded to the inwardly rolled rim. The top closure has integral therewith a flange portion 5 which extends downwardly around the exterior surface of the upper end of the tube. In the illustration the top closure is one which has beef formed from a circular disk blank. The forming of such a flanged top closure from a circular disk results in fold lines 6 on the flange 5 of the closure 4.

Figure 7:
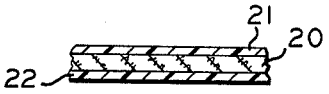
FIG. 7 is a fragmentary cross-sectional view of material which can be employed in preparing the sidewalls and closures of the instant invention.
Figure 8:
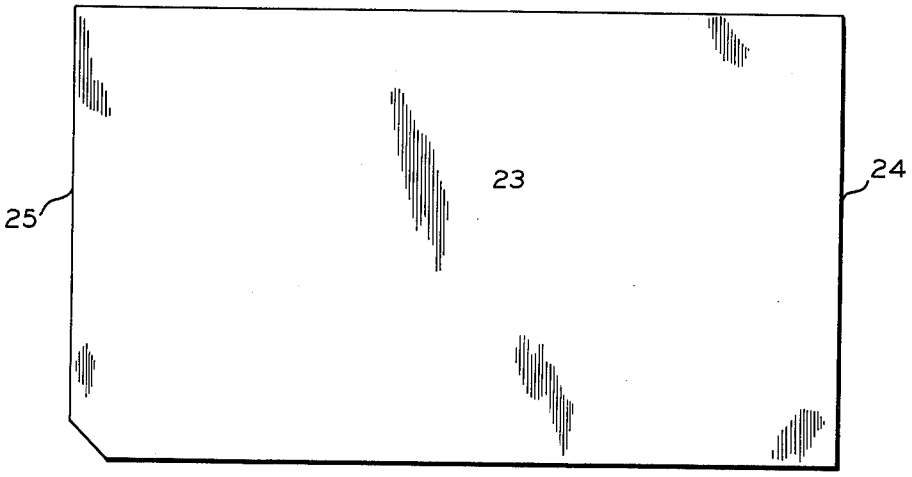
FIG. 8 is a plane view of a blank suitable for forming the sidewall of the container of the instant invention.

The preparation of a container of the type illustrated in FIG. 1 will now be discussed. In this specific example the sidewall 1, the top closure 4, and the bottom closure 2 are all constructed of paperboard of about 0.017 inch thickness, which paperboard has on both sides a coating of a thermoplastic material, such as polyethylene. A diagrammatical fragmentary cross-sectional view of such paperboard material is illustrated in FIG. 7 wherein the paperboard 20 has a thermoplastic coating 21 on one side and a thermoplastic coating 22 on the other side. The thermoplastic coating for the purpose of this example would be of a thickness in the range of about 0.0004 to about 0.001 inch. The sidewall can be formed by folding a generally rectangular blank 23 such as shown in FIG. 8 into a cylinder so that one side edge 24 of the sidewall blank overlaps the opposite side edge portion 25 of the sidewall blank. By preheating the portion of both side edges of the blank that will overlap one can obtain a bond along the point of overlapping due to the coating of thermoplastic on the blank. This is generally done on a forming mandrel. The attaching of the bottom closure to the sidewall can be accomplished in any suitable manner. For an example of such a technique see the above-cited U.S. Pat. No. 3,944,126. Thus a generally circular bottom closure having a downwardly depending skirt can be positioned with the outer surface of the skirt in contact with the inner surface of the lower portion of the sidewall. The bottom edge of the sidewall and the downwardly depending skirt of the bottom closure are heated to thermally bond the thermoplastic coatings which are in contact with each other. A crimping roller can engage the lower edge of the sidewall and roll the sidewall into engagement with the skirt in such a fashion as to form a crimped seal of the type illustrated at 7 in FIG. 1 of this application. Once the bottom closure has been secured, the container can be filled with the material that it is to contain, if desired. Then the upper edge of the sidewall is rolled inwardly, downwardly, and outwardly to form the inwardly rolled rim 3.

Figure 2:
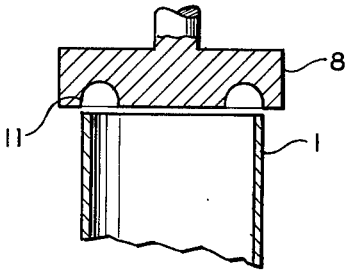
FIGS. 2 through 5 are cross-sectional views illustrating diagrammatically successive steps employed in preparing a container of the type illustrated in FIG. 1.
Figure 3:
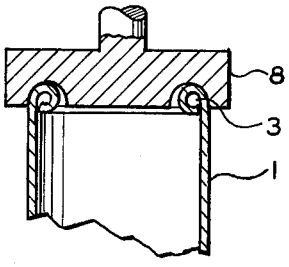

An example of how the inwardly rolled rim can be formed is illustrated in FIGS. 2 and 3. The inwardly rolled rim can be formed by a suitable rotating head 8 having a forming groove 11 which engages the upper end of the sidewall 1 and causes that end to be rolled inwardly, downwardly, and outwardly so that the inner edge of the upper end of the sidewall ends up in a position that is higher than the lowest portion of the rim.

Figure 4:
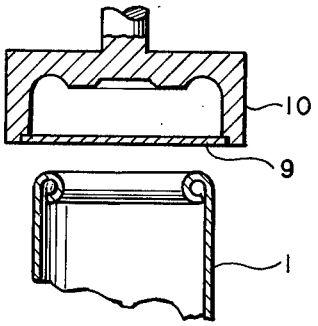
Figure 5:
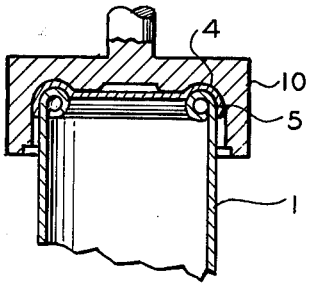

FIGS. 4 and 5 illustrate how a generally circular paperboard blank 9 can be formed into the top closure 4 while simultaneously being bonded to the rim 3. In FIG. 4 a suitable closure blank 9 is positioned and held in a reciprocating forming head 10. The container is accurately positioned under the reciprocating forming head 10. After at least either the rim 3 or the bottom of the closure blank 9 is heated to actuate the thermoplastic for bonding, the forming head 10 is moved downwardly over the container to the position shown in FIG. 5 such that the peripheral margin of the paperboard blank 9 is forced downwardly to form the flange 5 of the closure 4. The forming head 10 is held in this position until the plastic coating has cooled sufficiently to provide a good bond and is then withdrawn. Preferably when the forming head 10 is forced downwardly over the container, a clamp (not shown) is employed around the sidewall of the container to insure that the container remains cylindrical.

Figure 9:
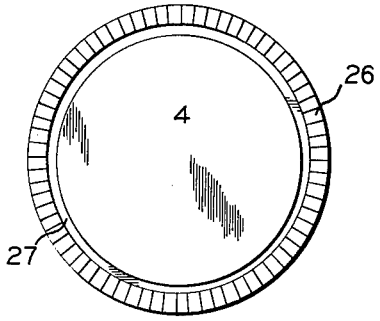
FIG. 9 is a bottom view of a blank suitable for forming the top closure of the inventive container.

When a closure is made by the technique just described, i.e., from a generally circular paperboard blank, it has proven advantageous to employ a paperboard blank such as illustrated in FIG. 9 wherein the bottom of the blank is provided with numerous score lines 26 around its circumference, with each score line 26 extending from the outer perimeter of the blank radially inwardly a distance substantially equal to the dimension A of the flange 5. The provision of such score lines makes the forming of the flange easier and results in a more continuous contact between the flange and the upper end of the container because it helps to facilitate the pleating of the flange as it is formed against the sidewall. The number of score lines needed for optimum pleating can be determined by routine experimentation.

It has also been found to be advantageous to provide the bottom of the top closure blank with a scored or embossed ring 27 concentric with the perimeter of the blank which ring is adapted to permit the upper surface of the rim 3 to fit within it. This embossed or scored ring 27 serves to help assure that the closure blank will be applied to the container in such a fashion that its perimeter is concentric with the perimeter of the container. The embossed or scored ring 27 also makes it easier for the blank to be folded downward to form the flange portion.

Figure 10:
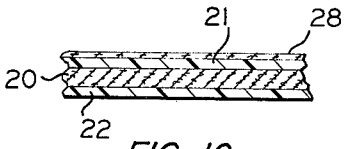
FIG. 10 is a fragmentary cross-sectional view of material which can be used for the top closure blank.

It has further been found advantageous if the paperboard blank has a thin layer of tissue paper laminated over its total upper surface. The layer of tissue helps to minimize the likelihood of a bond forming between the closure and the forming head due to the presence of thermoplastic on the upper surface of the closure blank. A cross-sectional view of a fragment of such a top closure blank is illustrated in FIG. 10 wherein the paperboard base 20 is covered with a thermoplastic coating 22 on the bottom side and a coating of thermoplastic 21 on the top side. To the coating 21 on the top side is bonded a layer of tissue paper 28.

One could readily substitute metal foil blank or a plastic film blank for the paperboard closure blank. In using metal foil it is preferred that the metal foil have a thermoplastic coating on its lower surface at least in the area where it is to be bonded to the container. By providing a thermoplastic coating on the bottom of the top closure blank a suitable bond can thus be obtained by merely heating the closure blank. This is particularly advantageous in situations where it is not desirable to apply heat to a filled container.

Figure 6:
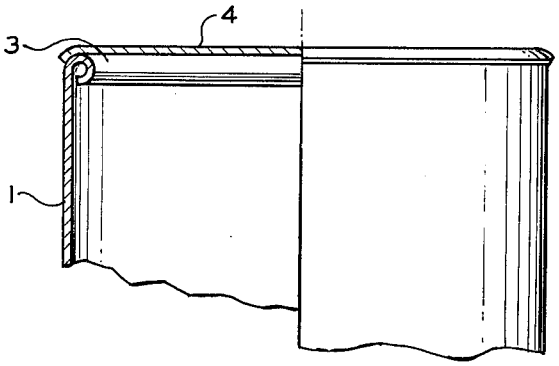
FIG. 6 is a fragmentary partial vertical cross-sectional view of the upper end of a cylindrical container in accordance with another embodiment.

FIG. 6 is a fragmentary partial vertical cross-sectional view of the upper end of another container which is an embodiment of the present invention. This embodiment differs from that illustrated in FIG. 1 in that the top closure 4 has no flange-like portion which extends downwardly around the sidewall. In this instance the diameter of the closure is such that it does not extend beyond the circle defined by the exterior of the upper end of the container. As with other containers within the scope of the present invention, in the container illustrated in FIG. 6 the top closure 4 can be formed of any suitable material, including for example, paperboard, metal foil or thermoplastic film.

Containers having structures as illustrated in FIGS. 1 and 6 have particularly desirable features. The inwardly rolled rim provides sufficient reinforcement that the top closure need not be of relatively rigid material. By having an inwardly rolled rim on the top and a closure of the type illustrated in FIG. 1 a container is obtained which is more easily positioned beside others on a shelf or in a shipping case than containers having outwardly disposed rims or closure portions. With containers having outwardly disposed rims or closure portions there is a tendency for the container to end up canted or tilted when placed adjacent other similar containers due to an overlapping of the outwardly disposed rims or closure portions of such containers.

It is to be noted that the present invention is subject to variations and modifications which are considered to be within the scope of this invention. For example, while much of the discussion was directed to containers in which the top closure was a disk, upper closures of other geometric shapes could also be employed. Likewise, the top closure could have integral therewith tabs which would aid in the removal of the closure. Alternatively, the closure could include other common means for obtaining access to the contents of the container, for example pour spouts of the type commonly used on salt cans.

What is claimed is:

1. A container having a cylindrical tubular sidewall; a bottom closure secured to said sidewall to seal the bottom end of the container; a rim being circumferentially continuous about the periphery of the top end of the container and being disposed completely within the confines of the tubular sidewall and comprising an upper end portion of the sidewall extending inwardly, downwardly, and outwardly so that the edge of the inner surface of the upper end of the sidewall is in a position which is higher than the lowest portion of said rim; and a top closure bonded to the upper surface of said rim so that a continuous line of bonding around the upper end of the container is provided; wherein said sidewall is constructed from a paperboard blank comprising a single ply of paperboard base stock having a thickness in the range of about 14 to about 28 mils and a basic weight of about 180 to about 360 pounds per 3,000 square feet; wherein said paperboard blank has a coating of thermoplastic on both surfaces thereof; wherein the opposite side edge margins of the paperboard blank are secured by heat sealing the thermoplastic coating on said blank in the area where the opposite side edge margins overlap; wherein the bottom closure comprises a generally circular paperboard disk having a skirt depending therefrom which skirt abuts the inner surface of the lower end of said sidewall, said bottom closure also having a coating of thermoplastic on both surfaces thereof; and wherein said bottom closure is secured to said sidewall by having the lower end of said sidewall crimped inwardly so that the inner side of said lower end of said sidewall is in contact with both the inner and outer surfaces of said flange and by having the thermoplastic on the inner side of the lower end of said sidewall heat sealed to both sides of said flange to provide on both sides of said flange a generally continuous line of bonding around the circumference of said flange; and wherein said top closure comprises generally circular paperboard having integral therewith a flange portion which extends downwardly around and in contact with the total circumference of a portion of the exterior surface of the upper end of said container sidewall, said flange being bonded to the exterior surface of said container at all points of contact therewith; and wherein said top closure has a coating of thermoplastic on its bottom side which is heat sealed to said rim to provide said continuous line of bonding around the upper end of the container and wherein said top closure is constructed from a flat paperboard disk having on its bottom surface a plurality of score lines around its circumference with each score line extending from the outer perimeter of the disk radially inwardly a distance substantially equal to the dimension of said flange portion of said top closure.

2. A container according to claim 1 wherein said disk has on its bottom surface a scored or embossed ring concentric with the perimeter of the blank which ring is adapted to permit the upper surface of the rim to fit within it.

3. A container according to claim 2 wherein said disk has a layer of tissue paper laminated to its total upper surface by a coating of thermoplastic coextensive with the upper surface of said disk.

* * * * *